US008932516B2

(12) United States Patent
Taguchi et al.

(10) Patent No.: US 8,932,516 B2
(45) Date of Patent: Jan. 13, 2015

(54) ALUMINUM POROUS BODY AND FABRICATION METHOD OF SAME

(75) Inventors: Masami Taguchi, Hitachi (JP); Kazutaka Okamoto, Tokai (JP); Akio Hamaoka, Hadano (JP); Kouji Sasaki, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 649 days.

(21) Appl. No.: 13/078,040

(22) Filed: Apr. 1, 2011

(65) Prior Publication Data

US 2011/0248205 A1 Oct. 13, 2011

(30) Foreign Application Priority Data

Apr. 1, 2010 (JP) ..... 2010-084772

(51) Int. Cl.

| | |
|---|---|
| ***B22F 3/11*** | (2006.01) |
| ***C22C 1/08*** | (2006.01) |
| ***B22F 3/10*** | (2006.01) |
| ***B22F 3/105*** | (2006.01) |

(52) U.S. Cl.

CPC ..... *C22C 1/08* (2013.01); *B22F 3/1003* (2013.01); *B22F 3/105* (2013.01); *B22F 2003/1014* (2013.01); *B22F 2003/1054* (2013.01)

USPC ..... 419/2; 419/32; 419/37; 419/38; 419/52; 252/62; 252/182.35; 252/71

(58) Field of Classification Search

CPC ..... B22F 3/1003; B22F 3/105; C22C 1/08

USPC ..... 75/252; 419/2

See application file for complete search history.

(56) References Cited

U.S. PATENT DOCUMENTS

| | | | | |
|---|---|---|---|---|
| 5,314,003 | A * | 5/1994 | Mackay | 164/494 |
| 5,352,538 | A * | 10/1994 | Takeda et al. | 428/553 |
| 2013/0136868 | A1 * | 5/2013 | Bruck et al. | 427/554 |

FOREIGN PATENT DOCUMENTS

JP 2004-285410 10/2004

OTHER PUBLICATIONS

Myers and German, "Rapid Prototyping of Aluminum by Selective Laser Sintering," Proceedings of 2002 International Conference on Metal Powder Deposition for Rapid Manufacturing, MPIF, Apr. 8-10, 2002, San Antonio, Tex., pp. 233-241.*

(Continued)

*Primary Examiner* — Jessee Roe
*Assistant Examiner* — Christopher Kessler
(74) *Attorney, Agent, or Firm* — Antonelli, Terry, Stout & Kraus, LLP.

(57) ABSTRACT

It is an objective of the present invention to provide an aluminum porous body which is formed of a pure aluminum and/or aluminum alloy base material and has excellent sinterability and high dimensional accuracy without employing metal stamping. There is provided an aluminum porous body having a relative density of from 5 to 80% with respect to the theoretical density of pure aluminum, in which the aluminum porous body contains 50 mass % or more of aluminum (Al) and from 0.001 to 5 mass % of at least one selected from chlorine (Cl), sodium (Na), potassium (K), fluorine (F), and barium (Ba). It is preferred that the aluminum porous body further contains from 0.1 to 20 mass % of at least one selected from carbon (C), silicon carbide (SiC), iron (II) oxide (FeO), iron (III) oxide ($Fe_2O_3$), and iron (II,III) oxide ($Fe_3O_4$).

16 Claims, 1 Drawing Sheet

(56) References Cited

OTHER PUBLICATIONS

Densification and Sintering of Ceramics, Engineered Materials Handbook Desk Edition, ASM International, 1995, p. 784-822.*

Jacobson and Humpston, Principles of Brazing, ASM International 2005, p. 122.*

R. David Thomas and Dan Kay, "Fluxes Used in Fusion Welding and Brazing," Industrial Minerals and Rocks—Commodities, Markets, and Uses (7th Edition) 2006, pp. 1423-1431.*

* cited by examiner

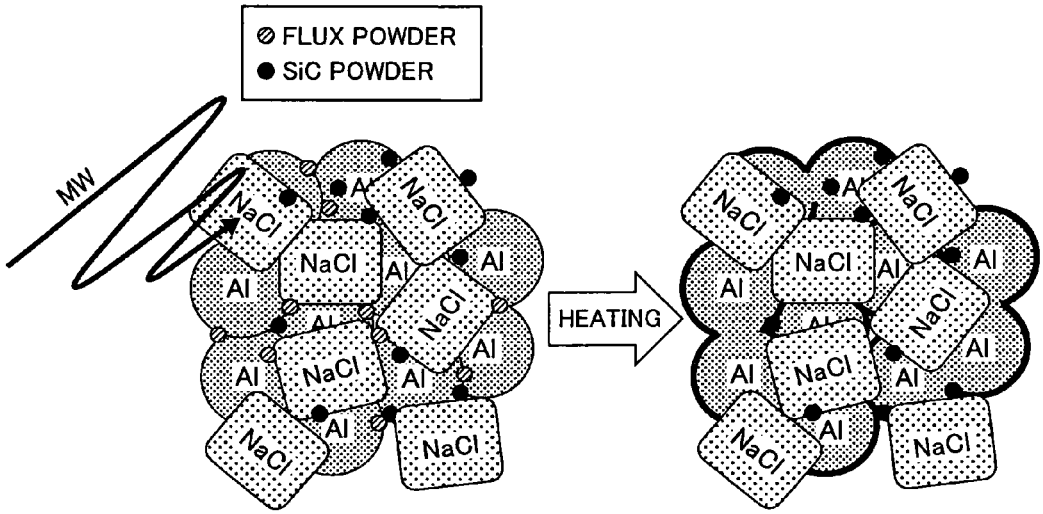
FLUX POWDER
SiC POWDER
MW
NaCl
Al
HEATING

ALUMINUM POROUS BODY AND FABRICATION METHOD OF SAME

CLAIM OF PRIORITY

The present application claims priority from Japanese patent application serial no. 2010-084772 filed on Apr. 1, 2010, the content of which is hereby incorporated by reference into this application.

BACKGROUND OF THE INVENTION

1. Field of the Invention

The present invention relates to an aluminum porous body and a method of fabricating the same.

2. Description of Related Art

Aluminum porous bodies are used as heat-exchanger materials, filter materials, shock/vibration-absorbing materials, sound-insulating/absorbing materials, and the like. An aluminum porous body is fabricated usually by molding a base material (e.g., powder material, chip material, fibrous material) of pure aluminum or aluminum alloy into a desired shape and joining the contact points of the base material by sintering or brazing.

Meanwhile, a base material of pure aluminum or aluminum alloy is known as a sintering-resistant material since it generally forms a coating of alumina ($Al_2O_3$), which is thermally very stable, on a surface thereof. Therefore, in order to obtain a sintered body of a pure aluminum base material or an aluminum alloy base material, it is necessary to subject the base material to high deformation at a molding stage to break the $Al_2O_3$ coating on the surface and to promote contact between newly-formed surfaces before subjecting the base material to liquid-phase sintering in the solid-liquid coexistence region.

For example, JP-A 2004-285410 discloses an aluminum porous body having a bulk density of not less than 0.20 g/cm$^3$ and not more than 1.20 g/cm$^3$. This aluminum porous body is obtained by cutting an aluminum clad material formed of an aluminum or aluminum alloy material clad with a brazing filler metal of aluminum alloy to form chips containing the brazing material, by molding the chips into a predetermined shape, and by subjecting the molded piece to brazing. The contact point joining percentage between the chips is not less than 25% and less than 50%.

Unfortunately, with conventional techniques such as the one described above, it is difficult to fabricate a porous body having a complex shape since conventional techniques inevitably involve molding a base material into a desired shape by metal stamping or the like as a preliminary step prior to the sintering or brazing process. Moreover, conventional techniques tend to be costly since each change in shape requires a new stamping die.

SUMMARY OF THE INVENTION

In view of the foregoing, it is an objective of the present invention to solve the above-described problems and to provide an aluminum porous body which is formed of a pure aluminum and/or aluminum alloy base material and has excellent sinterability and high dimensional accuracy without employing metal stamping. Furthermore, it is another objective of the invention to provide a method of fabricating such an aluminum porous body.

(I) According to one aspect of the present invention, there is provided an aluminum porous body having a relative density of from 5 to 80% with respect to the theoretical density of pure aluminum, in which the aluminum porous body contains 50 mass % or more of aluminum (Al) and from 0.001 to 5 mass % of at least one selected from chlorine (Cl), sodium (Na), potassium (K), fluorine (F), and barium (Ba).

In the above aspect (I) of the present invention, the following improvements and modifications can be made.

(i) The aluminum porous body further contains from 0.1 to 20 mass % of at least one selected from carbon (C), silicon carbide (SiC), iron (II) oxide (FeO), iron (III) oxide ($Fe_2O_3$), and iron (II,III) oxide ($Fe_3O_4$).

(II) According to another aspect of the present invention, there is provided a method of fabricating an aluminum porous body, in which the method comprises the steps of: mixing a raw material powder of pure aluminum and/or aluminum alloy with an aluminum brazing flux; shaping the raw material powder via the flux by irradiating the raw material powder mixed with the flux with a laser; and sintering the raw material powder by irradiating the shaped raw material powder with electromagnetic waves.

In the above aspect (II) of the present invention, the following improvements and modifications can be made.

(ii) The frequency of the electromagnetic waves ranges from 900 MHz to 30 GHz.

(iii) The aluminum brazing flux is a chloride-based flux or fluoride-based flux.

(iv) The chloride-based flux is mainly composed of barium chloride ($BaCl_2$), sodium chloride (NaCl), potassium chloride (KCl), or zinc chloride ($ZnCl_2$).

(v) The fluoride-based flux is mainly composed of aluminum fluoride ($AlF_3$), potassium tetrafluoroaluminate ($KAlF_4$), potassium pentafluoroaluminate ($K_2AlF_5$), or potassium hexafluoroaluminate ($K_3AlF_6$).

Advantages of the Invention

According to the present invention, it is possible to provide an aluminum porous body that is formed of a pure aluminum and/or aluminum alloy base material and has excellent sinterability and high dimensional accuracy without employing metal stamping. Also, it is possible to provide a method of fabricating such an aluminum porous body. As a result, a porous body having a complex shape can be easily provided.

BRIEF DESCRIPTION OF THE DRAWINGS

FIG. 1 is a schematic view of microwave heating of an aluminum porous body in accordance with an embodiment of the present invention.

DETAILED DESCRIPTION OF THE PREFERRED EMBODIMENTS

In recent years, product development cycles have become shorter and there is a growing need for producing prototypes rapidly and easily (i.e. at low cost). One solution to meet the need is rapid prototyping (hereinafter referred to as RP), which is a 3D modeling method to create only the outside shape of an object rapidly. RP is widely used to produce machine parts having complex shapes, prototypes based on which the suitability of industrial products of high esthetic quality is checked, or the like.

A technique for RP is called additive manufacturing, with which a multiplicity of thin unit layers are stacked to form a shape. More specifically, layers of a powder material are laid down and irradiated with a laser so that the powder is directly sintered or its particles are joined via a binder. In the case of a metallic powder, the surfaces of its particles are coated with a binder, or the metallic powder is mixed with a binder powder, and the binder is melted by laser irradiation so that the powder particles are joined to form a shape (preform), and then the metallic powder is sintered. In this way, with RP, complex-shaped structures which are difficult to make by metal stamping can be produced rapidly.

The most important feature (advantage) of the present invention resides in the fact that an aluminum porous body that has excellent sinterability and high dimensional accuracy can be provided without employing metal stamping, even though it is formed of a pure aluminum- and/or aluminum alloy-based powder, which is a sintering-resistant material, and even if it has a complex shape. Therefore, the aluminum porous body and the method of fabricating the same in accordance with the present invention can be preferably applied to RP.

Here, there is no particular limitation on the particle shape of the pure aluminum- and/or aluminum alloy-based powder used in an embodiment of the present invention as long as the size specifications described below are met. Also, aluminum alloy is defined as alloy containing at least 50 mass % of aluminum.

An embodiment of the present invention will be described hereinafter with reference to the accompanying drawing. In this regard, however, the present invention is not limited to the embodiment disclosed herein, and combinations and improvements may be made as appropriate without departing from the spirit and scope of the present invention.

As described before, a coating of $Al_2O_3$, which is thermally very stable, is formed on the surface of each particle of pure aluminum or aluminum alloy powder (hereinafter referred to as Al-system metallic powder), inhibiting the sintering of the powder particles. The inventors devoted themselves to study the sintering behavior of Al-system metallic powder and thought that if a liquid phase was created in the surface region of Al-system metallic powder particles by selectively heating the surfaces of Al-system powder particles, the $Al_2O_3$ coating would be pushed away to expose newly-formed surfaces (virgin surfaces) by the surface tension effect of the liquid phase, thus making it possible to sinter the particles.

Here, it is difficult to produce a liquid phase only in the surface region of each particle by typical electric-heater heating (radiation heating from outside). In the present invention, in contrast, the surface region of each particle is heated intensively by irradiation of electromagnetic waves at frequencies of 900 MHz to 30 GHz, making it possible to create a liquid phase in the surface region of each particle. However, in the case of heating metallic powder by electromagnetic irradiation, it is important to effectively insulate the metallic powder from the atmosphere since plasma otherwise would be generated and severe chemical reactions with the atmosphere would occur.

In the present invention, Al-system metallic powder is effectively insulated from the atmosphere by mixing an aluminum brazing flux in the Al-system metallic powder, thus making it possible to sinter the Al-system metallic powder by electromagnetic irradiation. In addition, since the aluminum brazing flux softens by laser irradiation, it also serves as an adhesive that bonds Al-system metallic powder particles, making it possible to produce a preform without employing metal stamping. In other words, the aluminum brazing flux also serves as a binder in additive manufacturing of RP, making it possible to fabricate a complex-shaped structure.

Although Al-system metallic powder can be induction-heated by electromagnetic irradiation, when the powder particle is small and the particle size becomes 1 mm or smaller, heating at frequencies of several kHz or so is difficult. In order to heat Al-system metallic powder with a particle size of 1 mm or smaller, the frequency range must be from 300 MHz to 300 GHz or so (the frequency range for the so-called microwaves). Meanwhile, the particle size is preferably 500 μm or smaller for improved sinterability of Al-system metallic powder. Also, in terms of workability, the particle size is preferably 0.5 μm or larger. As a result, in order to effectively heat Al-system metallic powder with a particle size of from 0.5 to 500 μm, it is preferred to use microwaves at frequencies ranging from 900 MHz to 30 GHz.

In general, when metal is heated by irradiating electromagnetic waves (microwaves), the electric current is concentrated on the surface of a target object by a skin effect. The degree of current concentration is referred to as current penetration depth. The current penetration depth depends on the frequency, and it becomes shallower as the frequency becomes higher. Therefore, by irradiating metallic powder with electromagnetic waves (microwaves), the surface region of each powder particle can be heated intensively.

In this regard, however, under microwave irradiation, chemical reactions between metallic powder and the atmosphere tend to become severe. For example, in the case of microwave-heating pure aluminum powder in nitrogen ($N_2$), Al combines with $N_2$ to generate aluminum nitride (AlN), making it difficult to sinter the aluminum powder particles. Meanwhile, inert gases such as argon (Ar) and helium (He) do not react with metal. However, they are easily brought into the state of plasma under microwave irradiation, often resulting in localized melting of metallic powder or hot spots. Therefore, they are ill suited as atmospheric gases. In addition, although plasma generation and chemical reactions between metallic powder and the atmosphere can be controlled under a high vacuum atmosphere of $1\times10^{-2}$ Pa or less, a costly vacuum pumping system is required and a lot of time is also required for vacuum pumping.

In the present invention, as described above, chemical reactions between Al-system metallic powder and the atmosphere, which tend to occur under microwave irradiation, can be prevented by effectively insulating the Al-system metallic powder from the atmosphere by mixing an aluminum brazing flux in the Al-system metallic powder. Preferable aluminum brazing fluxes include chloride-based fluxes (e.g., fluxes mainly composed of $BaCl_2$, NaCl, KCl, or $ZnCl_2$) and fluoride-based fluxes (e.g., fluxes mainly composed of $AlF_3$, $KAlF_4$, $K_2AlF_5$, or $K_3AlF_6$). Mixing these fluxes in Al-system metallic powder allows sintering by microwave irradiation even in the air atmosphere or $N_2$.

The surface of each particle of Al-system metallic powder can be moistened by setting the content of the flux mixed with the Al-system metallic powder at from 0.01 to 20 mass % (not less than 0.01 mass % and not more than 20 mass %), more preferably 0.01 to 10 mass %, and as a result the above-described effect is produced. If the content is more than 20 mass %, excessive contraction occurs during sintering, which adversely affects the dimensional accuracy of the finished product.

Although it is preferred that the flux be removed by washing after the sintering process, it may not be fully removed and part of it may remain. If the content of the remaining flux is 5 mass % or less, the mechanical strength of the sintered porous body remains almost unaffected. When a chloride-based flux is used, the less content of residual chloride, the better. If the residual chloride content in the sintered porous body is around 0.01 mass %, more preferably around 0.001 mass %, effects on the base material (e.g. corrosion) can be virtually ignored. For these reasons, the sintered aluminum porous body contains from 0.001 to 5 mass % of at least one flux component selected from Na, Cl, K, F, and Ba.

In the case of sintering Al-system metallic powder by microwave irradiation, when the relative density of the porous body exceeds 80% with respect to the theoretical density of pure aluminum, microwaves are prevented from penetrating the porous body, which makes intensive heating in the surface region of each particle by a skin effect difficult. Therefore, the upper limit on the relative density of the porous body is set at 80%.

Meanwhile, effective methods for reducing the relative density of the porous body (i.e., increasing its porosity) include a spacer method. In the case of Al-system metallic powder, NaCl can be preferably used as a spacer material. The relative density of an aluminum porous body fabricated by means of a spacer method can be reduced down to around 5% (maximum porosity: around 95%). In other words, according to the present invention, the relative density of an aluminum porous body can be controlled from 5 to 80%.

In the case of heating metallic powder by microwave irradiation, the heating behavior is strongly affected by the output of microwaves, the method of irradiation, etc. Particularly when the so-called multimode oven is used as a microwave applicator, the heat produced in specimens to be heat-treated is small and may not reach the sintering temperature. In such a case, heat production can be promoted by mixing a powdered microwave absorber (e.g., C, SiC, FeO, $Fe_2O_3$, and $Fe_3O_4$) in Al-system metallic powder. In this regard, however, adding too much of the microwave absorber rapidly increases the temperature and makes temperature control difficult. Therefore, it is preferred that the absorber content be 20 mass % or less.

On the other hand, when a single-mode oven is used as the microwave applicator, the specimens can be heated up to the sintering temperature without adding any powdered microwave absorber such as C, SiC, FeO, $Fe_2O_3$, and $Fe_3O_4$. However, adding around 0.1 mass % or more of a powdered microwave absorber increases the heating efficiency, and the Al-system metallic powder can be heated to the sintering temperature with less energy. Therefore, an aluminum porous body in accordance with the present invention preferably contains from 0.1 to 20 mass % of a microwave absorber such as C, SiC, FeO, $Fe_2O_3$, and $Fe_3O_4$.

FIG. 1 is a schematic view of microwave heating of an aluminum porous body in accordance with an embodiment of the present invention. The flux irradiated with a laser in RP partly melts and bonds the Al-system metallic powder particles. Then, as shown in FIG. 1, while being heated to the sintering temperature by microwave irradiation, the flux melts and moistens the surfaces of the Al-system metallic powder particles, thereby effectively insulating the Al-system metallic powder particles from the atmosphere and preventing chemical reactions between them. As a result, the Al-system metallic powder particles can be sintered effectively.

As described above, according to the present invention, the mixture of Al-system metallic powder, an aluminum brazing flux powder, a powdered microwave absorber, and a spacer material as needed is irradiated with a laser so that the flux is melted and these powders can be provisionally shaped without pressure. In other words, they can be shaped by RP. This process is followed by a sintering process by the irradiation of electromagnetic waves (microwaves), thereby making it possible to fabricate an aluminum porous body having high dimensional accuracy and/or a complex structure in a short period of time.

Moreover, the aluminum porous body in accordance with the present invention can be used as an ultra-lightweight material, high-specific-rigidity material, energy-absorbing material, vibration-absorbing material, electromagnetic wave-absorbing material, sound-insulating material, sound-absorbing material, heat-insulating material, electrode material, filter material, heat-exchanger material, biomedical material, oil-impregnated bearing material, etc.

EXAMPLES

An embodiment of the present invention will be described hereinafter on the basis of an example. However, the present invention is not to be considered limited to this.

In the example, the inventors used pure Al powder and AC4B (Al—Si—Cu casting alloy) powder (each 150 μm or smaller in particle size) as Al-system metallic powder, $AlF_3$ (50 μm or smaller in particle size) as a fluoride-based flux, NaCl (500 μm or smaller in particle size) as a spacer material, and SiC (5 μm or smaller in particle size) as a microwave absorber. A powdered pure Al base material and a powdered AC4B base material were prepared by mixing these powders using a V-mixer such that each mixture contains 25 mass % of Al-system metallic powder, 3 mass % of the flux, 2 mass % of the microwave absorber, and 70 mass % of the spacer material.

Each powder mix was provisionally formed into a circular cylindrical shape having 10 mm of diameter and 10 mm of height (ϕ10×10) by RP. RP was performed under conditions that the laser power was 15 W (beam diameter: 0.4 mm), the laser scanning speed was 7.6 m/sec., and the stack pitch was 0.1 mm.

Next, each sample of ϕ10×10 provisionally formed by RP was irradiated with microwaves at a frequency of 2.45 GHz in a single-mode microwave oven. The sintering process was carried out in a nitrogen atmosphere while applying a magnetic field. The microwave output was controlled such that the sintering temperature for the powdered pure Al base material was 645° C. and the sintering temperature for the powdered AC4B base material was 570° C. The times to reach the sintering temperatures were measured. The holding times at the sintering temperatures were changed in the range of 5 to 30 minutes. For comparison, specimens were also fabricated by sintering preforms shaped in a similar way by electric-heater heating using a typical heating oven under the same conditions of sintering temperature and time. Each of the specimens was subjected to ultrasonic cleaning in water to remove the spacer material after the sintering process.

Relative density measurement and appearance inspection were conducted on each sample. The relative density of each sample was calculated with respect to the theoretical density of pure aluminum (2.7 g/cm$^3$) from the bulk density of the specimen measured on the basis of its size and weight. The added spacer material (NaCl) was assumed to have been eluted entirely by the ultrasonic cleaning. Also, the appearance of each specimen was evaluated visually. Table 1 shows the results of the experiment in which specimens provisionally shaped by RP were sintered by microwave heating and electric-heater heating.

TABLE 1

Experimental Results

| | Preform | Time to Reach Sintering Temperature (min) | Holding Time (min) | Relative Density (%) | Appearance |
|---|---|---|---|---|---|
| Microwave Heating | Powdered Pure Al Base Material | 8 | 5 | 21 | G |
| | | | 10 | 22 | G |
| | | | 30 | 23 | R |
| | Powdered AC4B Base Material | 5 | 5 | 24 | G |
| | | | 10 | 24 | G |
| | | | 30 | 23 | R |
| Electric-heater Heating | Powdered Pure Al Base Material | 35 | 5 | — | D |
| | | | 10 | — | D |
| | | | 30 | — | D |
| | Powdered AC4B Base Material | 27 | 5 | 17 | R |
| | | | 10 | 19 | R |
| | | | 30 | 24 | R |

Evaluation of Appearance
G: Good,
R: Roughness or Shape Change, and
D: Degradation.

In the case of microwave heating, the time required for heating was short, and both of the powdered pure Al base material and the powdered AC4B base material could be heated to the target sintering temperature in 5 to 8 minutes. As a result of sintering the powder particles, porous bodies were fabricated. With either of the base materials, minor roughness (asperities) was observed partially on the surfaces of the specimens sintered for 30 minutes. However, there was little variation in relative density for different sintering times, and even with a short sintering time of 5 minutes, a nearly ideal relative density was obtained corresponding to the amount of the added NaCl spacer material.

In contrast, in the case of electric-heater heating, the time required to reach the target sintering temperature varied from 27 to 35 minutes, roughly 5 times the time of microwave heating. With the powdered pure Al base material, sintering was partly insufficient for either sintering time. Because the specimens degraded at the time of ultrasonic cleaning, relative densities could not be evaluated. With the powdered AC4B base material, significant roughness was observed for all the sintering times, and the shape itself changed when the sintering time is long. In the case of electric-heater heating, because temperature rising and cooling slow down due to the heat capacity of each specimen as a whole, the residence time at temperatures around the sintering temperature becomes long, and the surface of each specimen is heated most due to radiation heating, which was considered to have adversely affected the appearance and dimensional accuracy of the specimen.

These experimental results have demonstrated that an aluminum porous body having a high dimensional accuracy can be fabricated by heat treatment in a shorter time than ever.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A method of fabricating an aluminum porous body, comprising the steps of:

mixing an aluminum brazing flux with a raw material powder, the brazing flux comprising at least one of a chloride-based flux including zinc chloride and a fluoride-based flux including aluminum fluoride, and the raw material powder comprising at least one of pure aluminum and aluminum alloy;

controlling the relative density of the aluminum porous body within a range of from 5 to 80% with respect to the theoretical density of pure aluminum by mixing a spacer material with the aluminum brazing flux and raw material powder; and shaping the raw material powder via the flux by irradiating the raw material powder mixed with the flux with a laser; and sintering the raw material powder by irradiating the shaped raw material powder with electromagnetic waves; and removing the flux and the spacer material by washing after sintering.

2. The method of fabricating an aluminum porous body according to claim 1, wherein the frequency of the electromagnetic waves ranges from 900 MHz to 30 GHz.

3. The method of fabricating an aluminum porous body according to claim 2, wherein the particle size of the raw material powder is from 0.5 to 500 μm.

4. The method of fabricating an aluminum porous body according to claim 1, wherein the mixture of the aluminum flux and raw material powder has a flux content from 0.01 to 20 mass percent.

5. The method of fabricating an aluminum porous body according to claim 1, wherein the spacer material comprises sodium chloride.

6. The method of fabricating an aluminum porous body according to claim 1, wherein the spacer material comprises a material having heat resistance to withstand a sintering temperature in the sintering step and being soluble in water in the removing step.

7. The method of fabricating an aluminum porous body according to claim 1, further comprising the step of:

increasing the heating efficiency by the electromagnetic waves by mixing 0.1 to 20 mass percent of a powdered microwave absorber with the aluminum flux and raw material powder.

8. A method of fabricating an aluminum porous body comprising the steps of:

mixing an aluminum brazing flux with a raw material powder, the brazing flux comprising at least one of a chloride-based flux including zinc chloride and a fluoride-based flux including aluminum fluoride, and the raw material powder comprising at least one of pure aluminum and aluminum alloy;

shaping the raw material powder via the flux by irradiating the raw material powder mixed with the flux with a laser;

increasing the heating efficiency by electromagnetic waves by mixing 0.1 to 20 mass Percent of a powdered microwave absorber with the aluminum flux and raw material powder; and sintering the raw material powder by irradiating the shaped raw material powder with electromagnetic waves, wherein the powdered microwave absorber is selected from group consisting of carbon, silicon carbide, iron (II) oxide, iron (III) oxide and iron (II, III) oxide.

9. A method of fabricating an aluminum porous body, comprising the steps of:

mixing an aluminum brazing flux with a raw material powder, the brazing flux comprising at least one of a chloride-based flux and a fluoride-based flux, and the raw material powder comprising at least one of pure aluminum and aluminum alloy;

mixing a spacer material with the aluminum flux and raw material powder;

shaping the raw material powder via the flux by irradiating the raw material powder mixed with the flux with a laser; and sintering the raw material powder by irradiating the shaped raw material powder with electromagnetic waves; and removing the flux and the spacer material by washing after sintering.

10. The method of fabricating an aluminum porous body according to claim 9, wherein the aluminum brazing flux comprises a chloride-based flux including at least one of barium chloride, sodium chloride, potassium chloride, and zinc chloride.

11. The method of fabricating an aluminum porous body according to claim 9, wherein the aluminum brazing flux comprises a fluoride-based flux including at least one of aluminum fluoride, potassium tetrafluoroaluminate, potassium pentafluoroaluminate, and potassium hexafluoroaluminate.

12. The method of fabricating an aluminum porous body according to claim 9, wherein the mixture of the aluminum flux and raw material powder has a flux content from 0.01 to 20 mass percent.

13. The method of fabricating an aluminum porous body according to claim 9, wherein the spacer material comprises sodium chloride.

14. The method of fabricating an aluminum porous body according to claim 9, further comprising the step of:

mixing 0.1 to 20 mass percent of a powdered microwave absorber with the aluminum flux and raw material powder.

15. The method of fabricating an aluminum porous body according to claim 9, wherein the frequency of the electromagnetic waves ranges from 900 MHz to 30 GHz.

16. A method of fabricating an aluminum porous body comprising the steps of:

mixing an aluminum brazing flux with a raw material powder, the brazing flux comprising at least one of a chloride-based flux and a fluoride-based flux, and the raw material powder comprising at least one of pure aluminum and aluminum alloy;

shaping the raw material powder via the flux by irradiating the raw material powder mixed with the flux with a laser;

mixing 0.1 to 20 mass percent of a powdered microwave absorber with the aluminum flux and raw material powder; and sintering the raw material powder by irradiating the shaped raw material powder with electromagnetic waves, wherein the powdered microwave absorber is selected from group consisting of carbon, silicon carbide, iron (II) oxide, iron (III) oxide and iron (II, III) oxide.

* * * * *